United States Patent [19]

Iezzi et al.

[11] Patent Number: 4,470,897

[45] Date of Patent: Sep. 11, 1984

[54] METHOD OF ELECTROPLATING A CORROSION-RESISTANT ZINC-CONTAINING DEPOSIT

[75] Inventors: Robert A. Iezzi, Coopersburg; Arif Humayun, Bethlehem; Stavros G. Fountoulakis, Chalfont, all of Pa.

[73] Assignee: Bethlehem Steel Corp., Bethlehem, Pa.

[21] Appl. No.: 534,009

[22] Filed: Sep. 20, 1983

[51] Int. Cl.[3] ..... C25D 3/22; C25D 3/56

[52] U.S. Cl. ..... 204/43 Z; 204/55 R

[58] Field of Search ..... 204/16, 55 R, 55 Y, 204/43 Z, 43 T; 428/681

[56] References Cited

U.S. PATENT DOCUMENTS 3,061,525 10/1962 Grazen ..... 204/9

3,268,423 8/1966 Tumaszewski et al. ..... 204/40

OTHER PUBLICATIONS

Allen G. Gray, "Modern Electroplating", pp. 450–451, (1953).

*Primary Examiner*—G. L. Kaplan

*Attorney, Agent, or Firm*—William B. Noll

[57] ABSTRACT

This invention is directed to an electroplated product having improved resistance to corrosive attack, and to the method of making such product. More particularly, the invention hereof relates to a zinc or zinc-alloy electroplated product containing a homogeneous dispersion of corrosion inhibitive pigment produced by subjecting a ferrous substrate to an electroplating bath containing a corrosion inhibitive pigment, such as barium chromate.

4 Claims, No Drawings

METHOD OF ELECTROPLATING A CORROSION-RESISTANT ZINC-CONTAINING DEPOSIT

BACKGROUND OF THE INVENTION

This invention relates generally to the field of electrodeposition of zinc or zinc alloys from electroplating baths. More particularly, this invention relates to the electrodeposition of zinc or zinc-nickel alloys from an electroplating bath to which has been added a corrosion inhibitive pigment.

Zinc is one of the most widely used metallic coatings for steel surfaces to protect such surfaces from corrosion. Two widely practiced methods of applying zinc to a steel surface is hot dip coating and electroplating. The former produces relatively heavy coatings and the surface thereof is generally characterized by a spangled finish. An electroplated coating, on the other hand, is relatively thin with a smooth bright surface which may be painted. Additionally, the latter coating may be formed to a more drastic degree than a hot dip coating without adversely affecting the adhesion of the coating to the ferrous base.

Over the years there have been many attempts to improve the properties of an electroplated product, particularly the corrosion resistant properties of a zinc electroplated steel. To this end workers in the art began to look at zinc-alloy coatings. For example, in U.S. Pat. No. 2,419,231, an electroplating bath capable of depositing an alloy of 85% zinc and 15% nickel is disclosed. On the other hand, U.S. Pat. No. 3,420,754 reported on certain problems associated with the practice taught in the above patent. The answer, among other changes, was the adoption of a lesser and more restrictive nickel range for the alloy. While such a product possessed better corrosion resistance than a single metal coating, such as zinc, there were problems in producing the alloy coatings.

A major effort in the field of electroplating was in the use of additives to the electroplating bath to improve the properties of the coated product. For example, U.S. Pat. No. 4,249,999 teaches a method of electrolytically plating a steel strip with a zinc-nickel alloy by including in the electroplating bath a strontium compound. Heretofore one of the difficulties in electroplating zinc alloys was due to the presence of contaminants in the plating bath. For example, rather than producing a product having a bright finish, the finish was dull or at best an uneven brightness. This appearance was due to unavoidable fluctuations in plating conditions, bath temperature, bath composition, and changes in the pH of the bath, caused by the presence of contaminants in the bath. As a consequence, commercial zinc-nickel electroplated products were slow in developing.

U.S. Pat. No. 4,251,329 discloses a process for improving the corrosion resistant properties of a zinc-nickel electroplated product by the step of performing the electroplating operation in a bath containing a vanadium compound along with the zinc and nickel. Exemplary of a vanadium compound is vanadyl sulfate.

Attempts to improve the corrosion resistant properties of single metal electroplated products has also been practiced by the use of additives to the electroplating bath. In this regard see U.S. Pat. Nos. 4,064,320; 4,048,381; and 3,986,843. All such patents relate to zinc-iron based acidic electroplating processes in which one or more additives are selected from the group consisting of $Cr^{3+}$, $Cr^{6+}$, zirconium, tin and indium.

None of these efforts met with commercial success for one or more of a variety of reasons, many of which were confirmed during the investigation leading to this invention. Details of such investigations and the results thereof will be found in the specifications which follow.

SUMMARY OF THE INVENTION

This invention relates to an electroplated product characterized by improved resistance to corrosive attack, and to the method of making such product. More particularly, the invention hereof relates to a zinc or zinc-alloy electroplated product produced by subjecting a ferrous substrate to an electroplating bath containing a corrosion inhibitive pigment which is not readily soluble in said bath. A preferred bath for a zinc electroplated product is one containing $ZnCl_2$-$BaCl_2$-$NH_4Cl$, and the preferred pigment is $BaCrO_4$.

DETAILED DESCRIPTION OF PREFERRED EMBODIMENT

The present invention is directed to the electrodeposition of metal, particularly on a ferrous substrate, from an electroplating bath which contains a dispersion of a corrosion inhibiting pigment. Such invention, to be described in detail hereinafter, is based on the discovery that the salt spray corrosion performance of electrolytic zinc or zinc-alloy coatings is significantly improved by incorporating such pigment, preferably barium chromate particles, in the coating.

Such discovery was the result of an extensive investigation into various pigments which could be dispersed in an electrolytic plating bath. The pigments investigated included (a) nonoxidizing, i.e., phosphates, molybdates, metaborates, and silicates; and (b) oxidizing, specifically the chromates of barium, strontium, zinc, and lead. The findings with respect to the nonoxidizing pigments were less than dramatic. The coatings at best had equal, and in some situations inferior corrosion resistance to pure zinc coatings. However, the findings with the oxidizing pigments presented a different and varied picture.

For preparation of the coated samples, cold rolled steel was used as the substrate material for the production of all metal and metal-pigment composite samples. The samples were either 3×6-inch rectangular panels or round 6-inch diameter by 6-inch high cylinders, electroplated in a bench scale cell or on a rotating cathode laboratory facility, respectively. Panels were degreased, alkaline cleaned, pickled in a 50 g/l $H_2SO_4$ solution and electroplated; each step followed by water rinsing.

The electrodeposition of the composite coatings for the initial evaluation of the various types of pigments was done from a zinc sulfate bath containing 350 g/l $ZnSO_4.7H_2O$ and 30 g/l $(NH_4)_2SO_4$. The pigment concentration in the bath was varied between 4 and 32 g/l and was kept in suspension by mechanical agitation. The following plating conditions were employed:

| | |
|---|---|
| Current density | 100 ASF |
| Bath temperature | 50–55° C. (120–130 F) |
| Bath pH | 5.2–5.6 |
| Coating weight aim | 45 g/m$^2$ (0.15 oz/sq. ft) per side |
| Coating time | 128 sec or time to obtain coating weight |

Control panels were plated from the same plating bath before the addition of pigment. Due to the effects of pigment addition on plating efficiency, the plating time to obtain a constant coating weight had to be estimated from preliminary plating tests. Salt spray test results from this initial evaluation are presented in Table I.

TABLE I

RESULTS OF SALT SPRAY TEST FOR PIGMENTED ELECTROGALVANIZED SPECIMENS

| | Pigment Added in the Bath gm/liter | Time to 10% Red Rust(a) Hours | Corrosion Resistance Improvement |
|---|---|---|---|
| Zn Coating with | | | |
| Strontium Chromate | 0 | 48 | — |
| | 2 | 60 | 1.2 |
| | 4 | 72 | 1.5 |
| | 8 | 228 | 4.8 |
| | 16 | 564 | 11.8 |
| | 32 | 492 | 10.3 |
| Barium Chromate | 0 | 36 | — |
| | 4 | 48 | 1.3 |
| | 12 | 108 | 3.0 |
| | 20 | 138 | 3.8 |
| | 28 | 138 | 3.8 |
| Zinc Chromate | 0 | 55 | — |
| | 4 | 105 | 1.9 |
| | 8 | 72 | 1.3 |
| | 16 | 100 | 1.8 |
| | 32 | 115 | 2.1 |
| Lead Chromate | 0 | 72 | — |
| | 4 | 72 | 1.0 |
| | 8 | 72 | 1.0 |
| | 16 | 84 | 1.2 |
| | 32 | 60 | 0.8 |
| Zinc Phosphate | 0 | 55 | — |
| | 4 | 30 | 0.5 |
| | 8 | 30 | 0.5 |
| | 16 | 35 | 0.6 |
| | 32 | 35 | 0.6 |
| ZnNi Coating with | | | |
| Barium Chromate | 0 | 562(b) | — |
| | 4 | 1170(b) | 2.1 |
| | 8 | >2000(b) | >3.6 |
| | 16 | >2000(b) | >3.6 |
| | 32 | >2000(b) | >3.6 |

(a)salt spray cabinet test per ASTM B-117
(b)time to 1% red rust

The most significant improvement in corrosion resistance was realized with the chromates of strontium and barium. However, corrosion resistance is not the only measure of the suitability of a product. A visual evaluation of the coated products showed that the addition of any pigments in the zinc sulfate electroplating bath caused some degree of darkening, decreased the ductility and increased pitting of the zinc coatings. Such effects were attributed mainly to the interference of zinc plating by ions released in the bath through partial pigment dissolution.

The most pronounced change in coating appearance and mechanical properties was obtained with the chromates of strontium and zinc which contaminated the bath with $Cr^{+6}$ions. Analysis of plating baths in which 32 gm/l of barium, zinc and strontium chromates were dispersed, showed that they contained 0.1, 0.8 and 4.7 g/l $Cr^{+6}$, respectively. While the coatings produced from the barium chromate-containing bath were dark metallic gray, they were quite acceptable. However, those coatings produced from the zinc and strontium chromate containing baths were black or green powdery coatings. It was concluded that the mechanical properties and appearance of the coatings deteriorate with increasing pigment solubility in the plating bath. That is, further tests revealed that coatings produced from baths containing more than 0.3 gm/l $Cr^{+6}$ added as $CrO_3$ were black and powdery. This indicates that the chromates of zinc and strontium, which released more than 0.3 g/l $Cr^{+6}$ in the bath, cannot produce acceptable coatings.

While barium chromate represented the ideal candidate as a pigment addition, it was not without its problems. A determination of the long-term effect of barium chromate on plating bath contamination was made. To a conventional zinc sulfate plating bath was added 8 gm/l $BaCrO_4$. Coatings produced after 4 hours of plating bath "aging" were dark gray, brittle and nonadherent. The deterioration of adhesion to the substrate and of mechanical properties of the coating were due to the contamination of the bath. It was, however, determined that the adverse effects of such a bath could be reduced, i.e. reduced rate of pigment dissolution, by using a bath that does not contain ammonium sulfate, has low acid concentration, or contains a buffer, such as $H_3BO_3$.

While the above approach represented an attempt to resolve the pigment solubility or contamination problem, another approach was to investigate an all-chloride type bath. The results of this evaluation of such chloride baths is presented in TABLE II. The best coatings were those where the $Cr^{+6}$ solubility was less than 10 ppm. The least deterioration of composite coatings with time and the lowest pigment solubility was achieved either with a $ZnCl_2$-$BaCl_2$ bath or with the more conductive bath of $ZnCl_2$-$BaCl_2$-$NH_4Cl$.

TABLE II

Evaluation of Zinc Chloride Electroplating Baths

| Bath | $Cr^{+6}$ Solubility(a) (ppm) | Coating(b) Evaluation |
|---|---|---|
| A. Neutral Zinc Chloride Bath<br>87 g/l $ZnCl_2$<br>130 g/l $NH_4Cl$<br>$NH_4OH$ to pH = 7.2<br>60 g/l Citric Acid or Malic Acid | 100–200 | acceptable |
| B. 250 g/l $ZnCl_2$<br>100 g/l $BaCl_2$<br>pH = 3.7–4.5 | <10 | good |
| C. 250 g/l $ZnCl_2$<br>100 g/l $NH_4Cl$<br>pH = 4.0 | >300 | poor |
| D. 136 g/l $ZnCl_2$<br>80 g/l $NH_4Cl$<br>61 g/l $BaCl_2.2H_2O$<br>pH = 4.4 | <10 | good |
| E. 136 g/l $ZnCl_2$<br>88 g/l NaCl<br>61 g/l $BaCl_2.2H_2O$<br>pH = 4.4 | <10 | good |
| F. 250 g/l $ZnCl_2$<br>100 g/l $NH_4Cl$<br>100 g/l $BaCl_2$<br>pH = 3.5–4.5 | <10 | good |

(a)concentration of soluble chromium formed in the bath through addition of 8 g/l $BaCrO_4$ to bath and kept in suspension for >2 days
(b)composite-coating evaluation:
Good = smooth, bright, metallic gray
Acceptable = smooth, dark gray
Poor = rough, powdery Analysis of the data from TABLE II indicates that the most effective results with barium chromate came from those baths containing brium chloride, particularly Baths D and F, containing in addition $ZnCl_2$ and $NH_4Cl$. Also, it will be observed that low pH values in the range of at least 3.5, with a preferred maximum of about 4.5, were the optimum.

While the bath may contain as little as 8 g/l of barium chromate to be effective, investigation have shown that even up to 100 g/l $BaCrO_4$ there is no product quality deterioration. Within such a bath range for the concentration of barium chromate, it is possible to produce an electroplated product having barium chromate present as discrete particles in a typical range of about 1 to 5%, by weight, of the electroplated zinc or zinc alloy and the barium chromate particles, which possess superior corrosion resistant properties.

We claim:

1. A method of producing a zinc-containing electroplated ferrous product having improved corrosion resistance, comprising the steps of:

(a) selecting a ferrous substrate suitable for the reception of a zinc-containing electroplated coating;

(b) preparing a zinc-containing electroplating chloride bath having a pH of at least 3.5;

(c) adding to said bath barium chromate as a corrosion inhibitive pigment in the amount of at least 8 gm/l; and (d) passing said ferrous substrate through said bath while applying electric current to said bath whereby a coating containing particles of said barium chromate is applied to said ferrous substrate.

2. The method according to claim 1 wherein said electroplating bath contains $ZnCl_2$-$BaCl_2$.

3. The method according to claim 2 wherein said pigment is a chromate and the concentration of $Cr^{+6}$ in said electroplating bath is maintained at less than 0.3 g/l/.

4. The method according to claim 1 wherein said electroplating bath contains $ZnCl_2$-$BaCl_2$-$NH_4Cl$.

* * * * *